US006817362B2

(12) United States Patent
Gélinas et al.

(10) Patent No.: US 6,817,362 B2
(45) Date of Patent: Nov. 16, 2004

(54) RESPIRATOR

(75) Inventors: Daniel Gélinas, Mont St-Hilaire (CA); Breck Andrew Petrillo, Providence, RI (US)

(73) Assignee: North Safety Products Inc., Cranston, RI (US)

( * ) Notice: Subject to any disclaimer, the term of this patent is extended or adjusted under 35 U.S.C. 154(b) by 0 days.

(21) Appl. No.: 10/110,702

(22) PCT Filed: Aug. 10, 2001

(86) PCT No.: PCT/CA01/01148

§ 371 (c)(1),
(2), (4) Date: Apr. 12, 2002

(87) PCT Pub. No.: WO03/013657

PCT Pub. Date: Feb. 20, 2003

(65) Prior Publication Data

US 2003/0029454 A1 Feb. 13, 2003

(51) Int. Cl.[7] ..... A62B 18/08

(52) U.S. Cl. ..... 128/206.17; 128/206.12; 128/206.21

(58) Field of Search ..... 128/205.25, 205.27, 128/205.29, 205.28, 206.12, 206.13, 206.15, 206.16, 206.17, 206.192, 206.21, 206.24, 206.26, 206.27, 206.28, 207.11, 207.12, 201.22, 201.25, 201.28, 201.23

(56) References Cited

U.S. PATENT DOCUMENTS

| | | | | |
|---|---|---|---|---|
| 1,502,450 A | * | 7/1924 | Wood | 128/206.13 |
| 2,505,173 A | | 4/1950 | Conley | |
| 2,578,007 A | * | 12/1951 | Hill | 128/206.17 |
| 2,652,828 A | | 9/1953 | Matheson | |
| 2,664,887 A | | 1/1954 | Green | |
| 2,668,532 A | * | 2/1954 | Evans | 128/206.17 |
| 2,845,926 A | * | 8/1958 | Hill | 128/206.17 |
| 2,845,927 A | | 8/1958 | Hill | |
| 2,922,417 A | | 1/1960 | Bradley et al. | |
| 3,118,445 A | | 1/1964 | Norman | |

(List continued on next page.)

FOREIGN PATENT DOCUMENTS

| | | |
|---|---|---|
| DE | 1 802 814 | 6/1970 |
| DE | 196 07 656 A1 | 9/1997 |
| EP | 0 109 514 A1 | 9/1983 |
| EP | 0 558 147 A1 | 2/1993 |
| FR | 1252997 A1 | 12/1960 |

*Primary Examiner*—Henn Bennett
*Assistant Examiner*—Teena Mitchell
(74) *Attorney, Agent, or Firm*—Wolf, Greenfield & Sacks, P.C.

(57) ABSTRACT

A respirator comprising a facepiece having a cup shaped portion for sealingly engaging a face of a wearer and covering the mouth and nose of the wearer and a cover having a cup shape that is complementary to the cup shaped portion of the facepiece. The cover is capable to detachably mate with the facepiece to define with the facepiece a void area that is cup-shaped and suitable to receive a filter having a complementary shape. The filter includes an apex portion, a side portion depending from the apex portion and a continuous flange portion surrounding said side portion and projecting laterally therefrom.

30 Claims, 7 Drawing Sheets

U.S. PATENT DOCUMENTS 3,161,491 A 12/1964 Gongoll et al.
3,330,274 A 7/1967 Bennett
3,521,630 A 7/1970 Westberg et al.
3,861,381 A 1/1975 Witman et al.
3,908,648 A * 9/1975 McCosker ..... 128/206.17
3,915,165 A 10/1975 Rambosek et al.
4,155,358 A 5/1979 McAllister et al.
4,414,973 A 11/1983 Matheson et al.
4,494,538 A 1/1985 Ansite
4,501,272 A 2/1985 Shigematsu et al.
4,549,543 A 10/1985 Moon
4,579,113 A 4/1986 McCreadie et al.
4,592,350 A 6/1986 Maryyanek et al.
4,628,927 A 12/1986 Ward
4,630,604 A 12/1986 Montesi
4,729,371 A 3/1988 Krueger et al.
4,771,771 A * 9/1988 Walther ..... 128/201.25
4,790,306 A 12/1988 Braun et al.
4,827,924 A 5/1989 Japuntich
4,856,508 A 8/1989 Tayebi
4,873,972 A 10/1989 Magidson et al.
4,883,547 A 11/1989 Japuntich
4,934,362 A 6/1990 Braun
4,981,134 A * 1/1991 Courtney ..... 128/207.12
5,036,844 A 8/1991 Pouchot et al.
5,062,421 A 11/1991 Burns et al.
5,080,094 A 1/1992 Tayebi
5,148,803 A 9/1992 Schlobohm
5,357,947 A * 10/1994 Adler ..... 128/201.13
5,372,130 A 12/1994 Stern et al.
5,394,568 A 3/1995 Brostrom et al.
5,427,092 A 6/1995 Shiao
5,481,763 A 1/1996 Brostrom et al.
5,535,736 A * 7/1996 Jzaw ..... 128/202.26
5,592,935 A 1/1997 Elstran et al.
5,615,767 A 4/1997 Eull et al.
5,619,989 A 4/1997 Kruger
5,659,296 A 8/1997 Debe et al.
5,666,949 A 9/1997 Debe et al.
5,689,833 A 11/1997 Allen et al.
5,701,892 A 12/1997 Bledstein
5,720,280 A 2/1998 Elstran et al.
5,720,281 A 2/1998 Allen et al.
5,724,677 A 3/1998 Bryant et al.
5,924,420 A 7/1999 Reischel et al.
6,098,201 A 8/2000 Boros, Sr.
6,216,693 B1 4/2001 Rekow et al.
6,435,184 B1 * 8/2002 Ho ..... 128/206.21

* cited by examiner

RESPIRATOR

RELATED APPLICATIONS

This application claims priority under 35 U.S.C. §120 to International Application No. PCT/CA01/01148, entitled, "Respirator," filed Aug. 10, 2001, which is hereby incorporated by reference in its entirety.

FIELD OF THE INVENTION

The present invention relates to a respirator comprising a facepiece and a cover. The cover is movable between a first position, in which the cover mates with the facepiece and a filter is received therebetween, to a second position, in which a wearer can install or remove the filter. The filter includes an apex portion, a side portion depending from the apex portion and a continuous flange portion surrounding said side portion and projecting laterally therefrom.

BACKGROUND OF THE INVENTION

Respirators are a common safety device used by people working in air contaminated environments. People such as construction workers often use respirators to prevent dust and other air contaminants from entering their respiratory tracts. Respirators are worn over the wearer's breathing passages and work to prevent the wearer from inhaling harmful substances when the wearer is in an environment that contains unsafe air particles.

A common respirator is the facepiece that simply comprises a permeable filtration media formed into a cup-shaped to fit the contour of the face of the wearer. This respirator comprises an elastic strap that extends around the head of the wearer. In other respirators a nose clip is attached to the respirator and is utilized to seek to obtain a seal around the nose area. Respirators of either type are disposable and cannot be used repeatedly since the filtration media becomes saturated after extended exposure to a contaminated environment.

Some tightly fitting respirators have a non-porous elastomeric facepiece that supports removable or permanently-attached filters.

There is a need in the industry to provide a novel respirator that can be used for long periods of time and will be comfortable.

SUMMARY OF THE INVENTION

As embodied and broadly described herein, the invention seeks to provide a respirator comprising: a facepiece having a cup shaped portion for sealingly engaging a face of a wearer and covering the mouth and nose of the wearer; a cover having a cup shape that is complementary to the cup shaped portion of said facepiece, said cover being capable to detachably mate with said facepiece to define with said facepiece a void area; and said void area being cup-shaped and suitable to receive a filter having a complementary shape.

As embodied and broadly described herein, the invention further seeks to provide a respirator comprising: a facepiece having a cup shaped portion for sealingly engaging a face of a wearer and covering the nose and mouth of the wearer; a cover having a cup shape that is complementary to the cup shaped portion of said facepiece, said cover being capable to detachably mate with said facepiece to define with said facepiece a void area; and a filter having a cup shape, said filter is received in said void area.

As embodied and broadly described herein, the invention further seeks to provide a disposable filter having a cup shape and dimensions such as to cover a wearer's mouth and nose, said disposable filter being adapted to be received in a void area defined between a facepiece and a cover of a respirator, said facepiece having a cup shaped portion for sealingly engaging a face of the wearer and covering the mouth and nose of the wearer, said cover having a cup shape that is complementary to the cup shaped portion of said face piece, said cover being capable to detachably mate with said facepiece.

Preferably, the facepiece comprises a first continuous surface and the cover comprises a second continuous surface, these continuous surfaces being complementary and operable to sealingly engage the filter therebetween when the facepiece is mated with the cover. These continuous surfaces surround the mouth and nose of the wearer. Furthermore, the facepiece comprises first and second parts, the first part being more pliable than the second part, the first part defining a continuous seal for sealingly engaging the face of the wearer and cover the mouth and nose of the wearer.

The respirator further comprises inhalation and exhalation valves mounted to the second part of the facepiece. The exhalation valve is designed to open in response to pressure from exhaled air and to remain closed between breaths and when the wearer inhales. Moreover, the cover is hingedly attached to the facepiece and comprises at least one releasable latch for locking the cover to the facepiece.

Most preferably, the facepiece comprises two V-shaped members, each V-shaped member having first and second branches, each of first and second branches has a longitudinal aperture adapted to receive a portion of a strap.

The filter preferably comprises a recess defined on the apex portion, the recess being generally circular. Furthermore, the flange of the facepiece includes first, second and third sections that are concave and that merge together through rounded corners. The filter has a generally triangular figure.

BRIEF DESCRIPTION OF THE DRAWINGS

A detailed description of the preferred embodiment of the invention is provided herein with reference to the following drawings, wherein.

Figure 1:
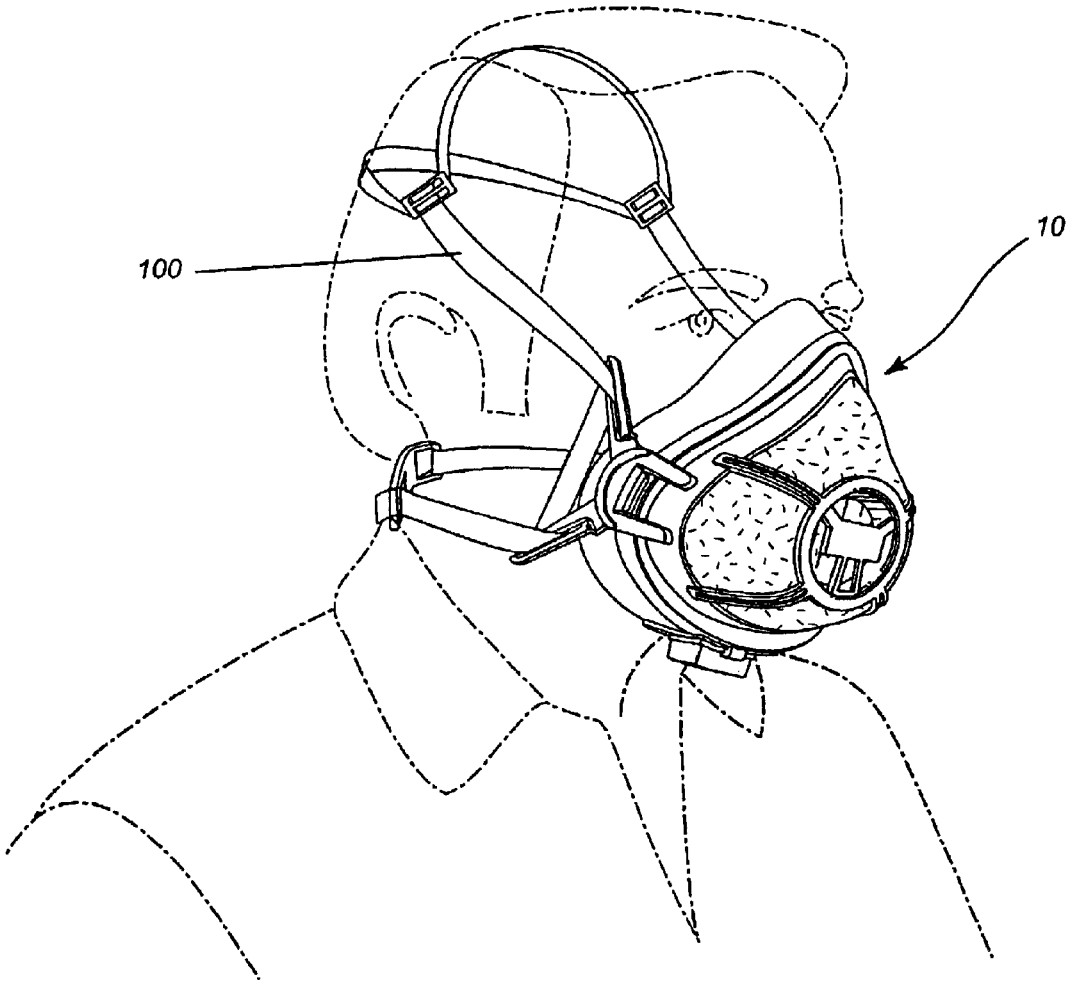
FIG. 1 is a perspective view of a respirator constructed in accordance with an embodiment of the invention wherein the respirator is worn by a wearer.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE PREFERRED EMBODIMENT

Figure 2:
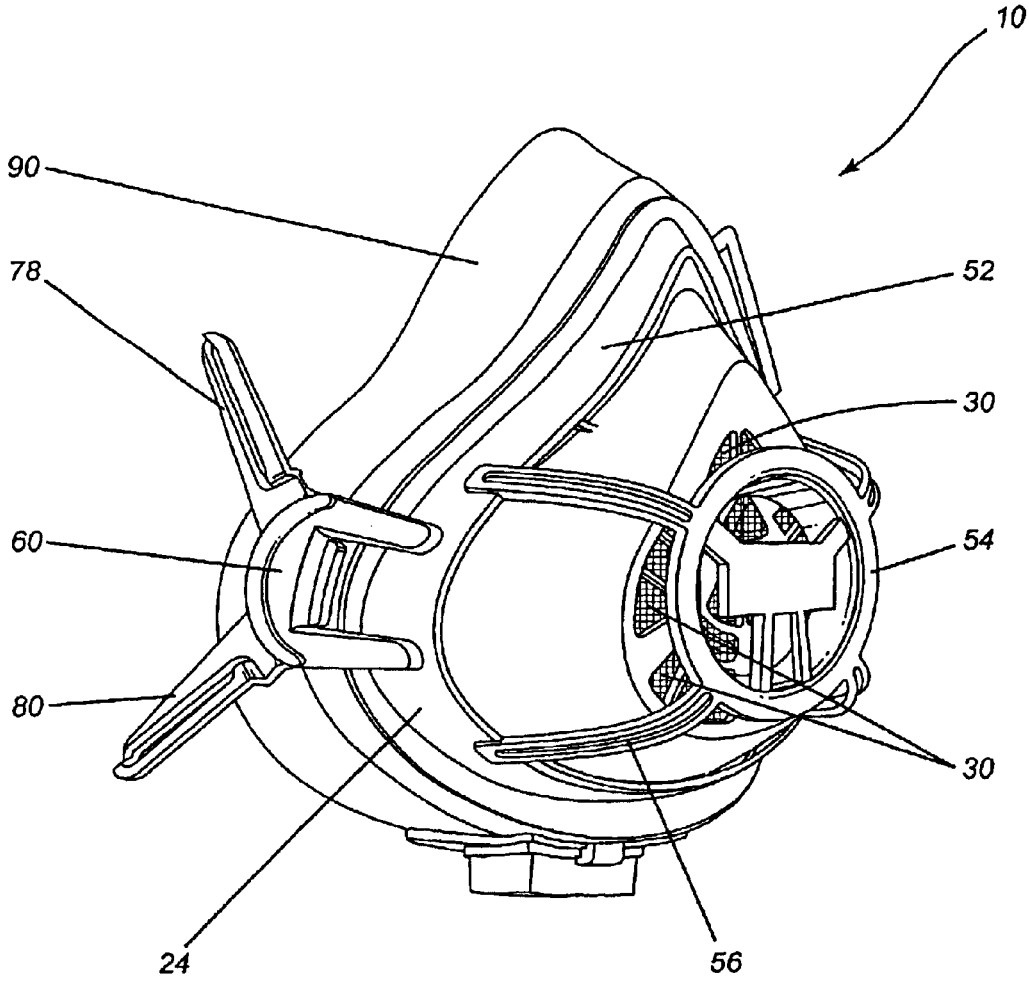
FIG. 2 is a perspective view of the respirator of FIG. 1 without a disposable filter.
Figure 3:
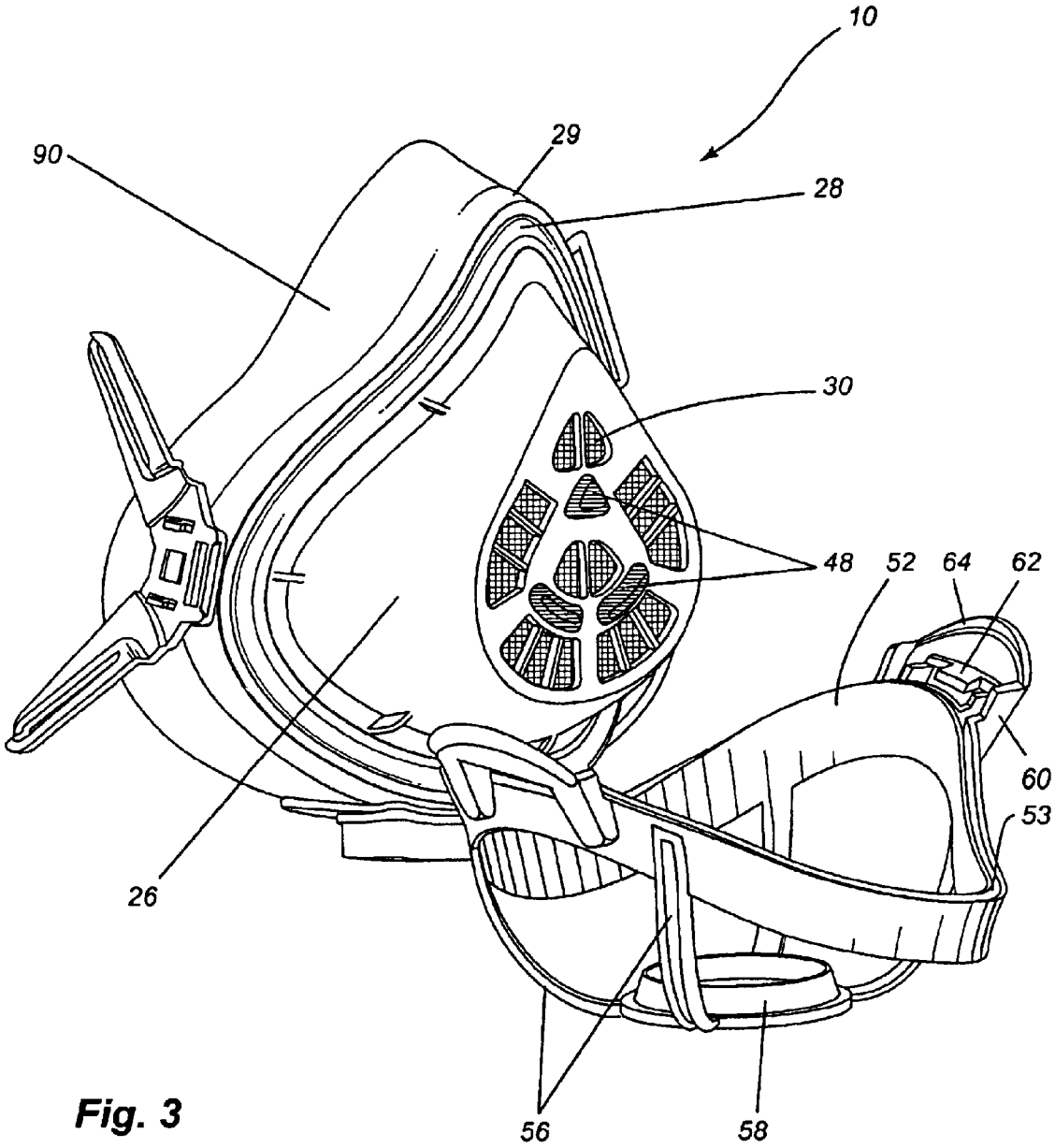
FIG. 3 is a perspective view of the respirator of FIG. 1, without the filter and with the cover shown in a first position.

Referring now to the drawings, FIGS. 1 to 7 illustrate a respirator constructed in accordance with an embodiment of the present invention, which is generally designated by the reference number 10. FIGS. 2 and 3 illustrate respirator 10 without a disposable filter.

Respirator 10 is reusable and is adapted to receive and maintain a disposable filter that may be designed to protect a wearer from particulate, dust, smoke, oil, fumes and/or gases or vapors. Respirator 10 is thus adapted to receive a variety of disposable filters that are designed to protect the wearer in different environmental conditions. The filters may be composed of any combination of filter media, protective layers and carbon media that will protect the wearer from breathing in the undesirable substances.

In a non-limiting example, respirator 10 is used as a particulate and gas/vapor respirator adapted to receive a disposable filter 12 comprising a particulate filter layer and a carbon media. Filter 12 has dimensions such as to cover the mouth and nose of a wearer and comprises an apex portion 14, a side portion 16 depending from apex portion 14 and a continuous flange portion 18 surrounding side portion 16, flange portion 18 projecting laterally from side portion 16.

Flange portion 18 comprises a first section 18*a* that overlies the chin of the wearer. First section 18*a* is concave. Flange portion 18 also comprises second and third sections 18*b* and 18*c* merging with first section 18*a* through rounded corners 18*d*. Second and third sections 18*b* and 18*c* are concave to a lesser degree than first section 18*a*. Flange portion 18 defines a generally triangular figure. Filter 12 also comprises a generally circular recess 20 formed on apex portion 14. The material of flange portion 18 may be compressed for increasing its rigidity.

Respirator 10 comprises two (2) main components, namely, a facepiece 22 and a cover 24. Facepiece 22 has a first part 90 and a second part 92. Second part 92 is made of a rigid or semi-rigid lightweight material such as plastic. First part 90 is more pliable than second part 92 and is made of a soft, flexible, elastomeric material such as natural rubber which provides added comfort to the wearer.

First part 90 surrounds the nose and mouth of the wearer in an attempt to prevent the wearer from inhaling the substances that respirator 10 aims to filter. In fact, first part 90 defines a continuous seal for sealingly engaging the face of the wearer and covering the mouth and nose of the wearer. First part 90 thus ensures that respirator 10 will fit many different faces and form a seal with the skin of the face of the wearer.

Second part 92 of facepiece 22 has a cup shaped portion 26 having a continuous surface 27 that extends laterally therefrom and encircles the nose and mouth of the wearer.

Figure 6:
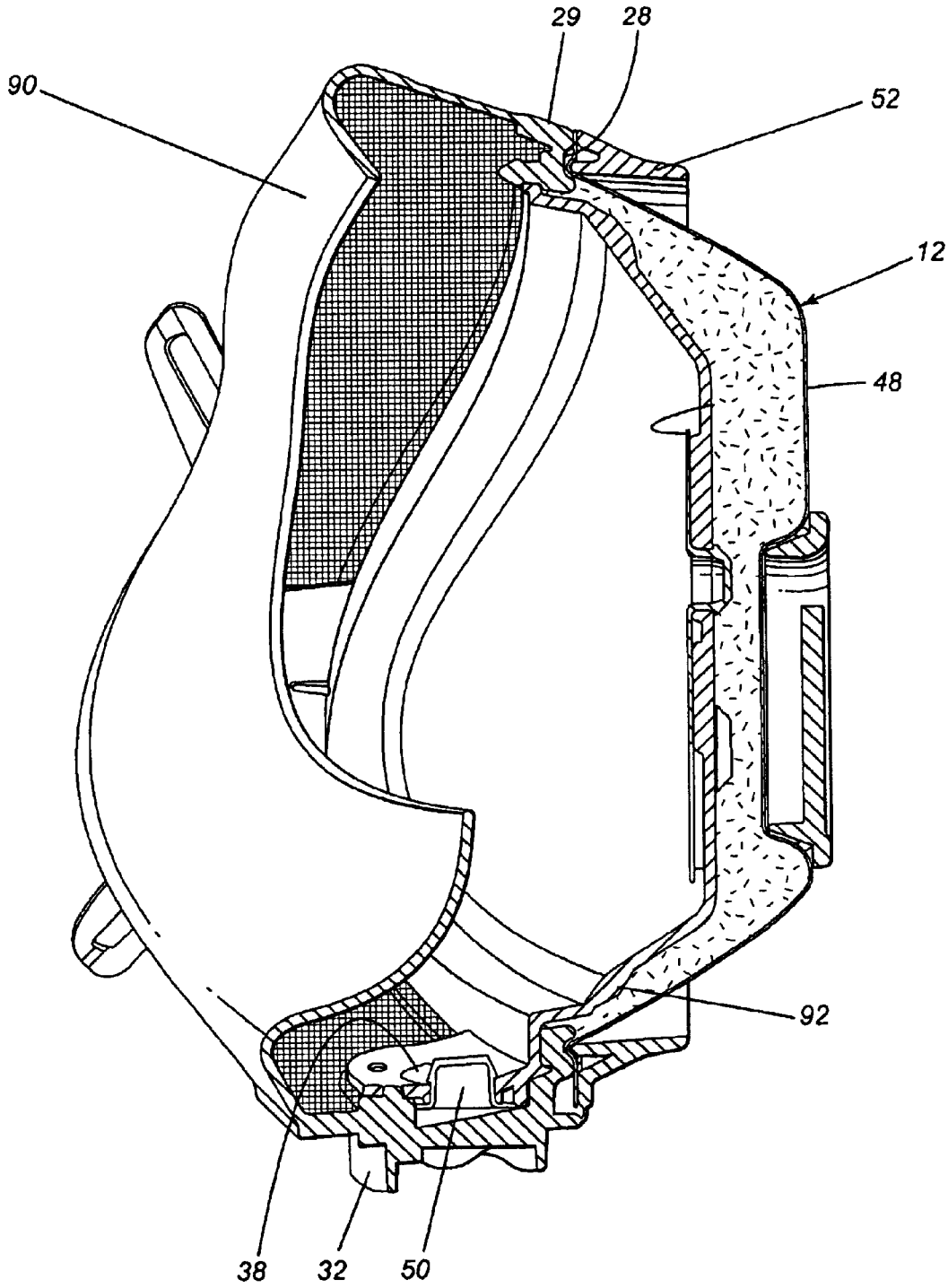
FIG. 6 is a cross section of the respirator of FIG. 1.
Figure 7:
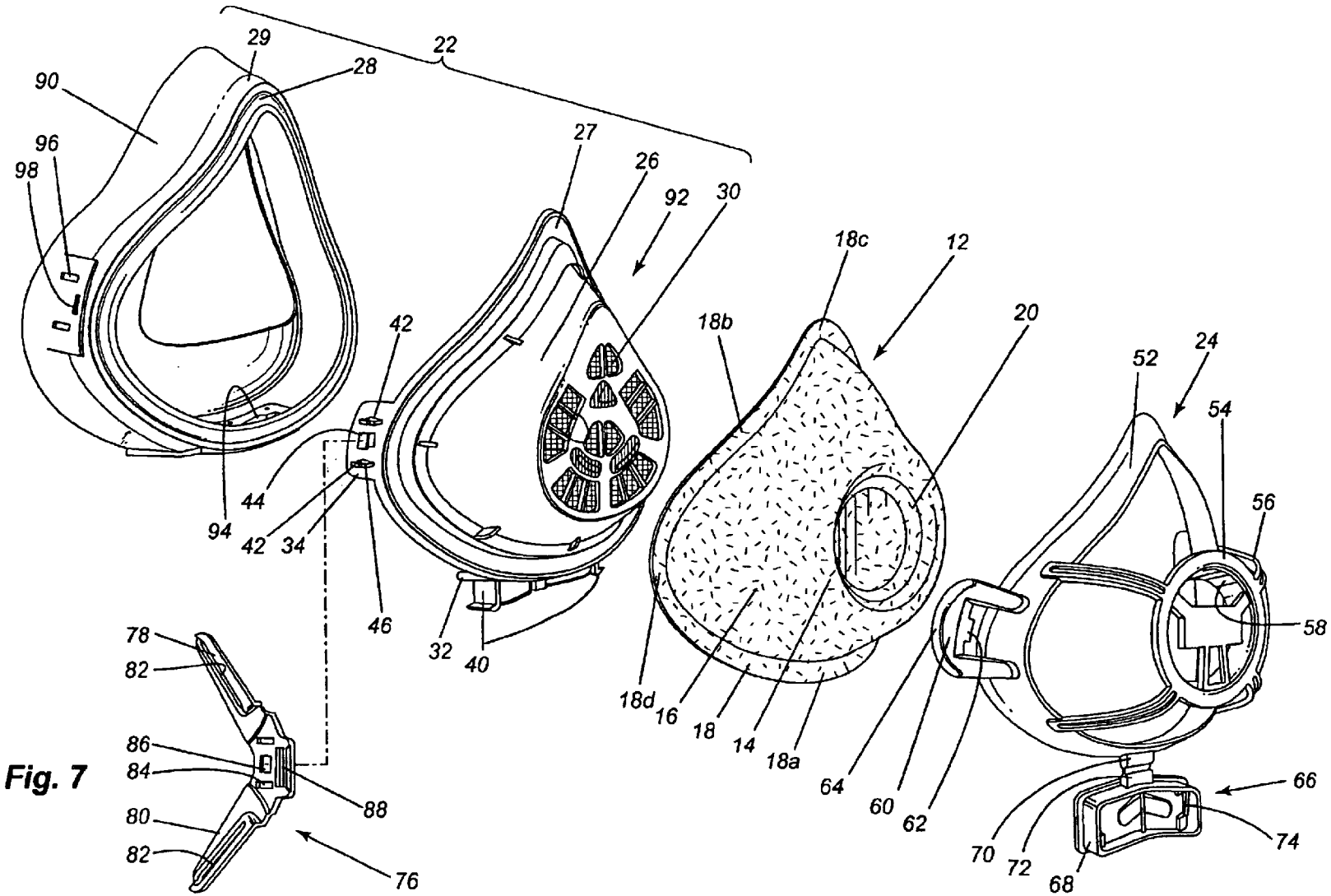
FIG. 7 is an exploded perspective view of the respirator of FIG. 1.

It is understood that first part 90 can be secured to second part 92 by different means such as mechanical securing means, chemical affixing means or through-molding processes. For instance, as best seen in FIGS. 3, 6 and 7, the first part 90 comprises a peripheral portion 29 covering the continuous surface 27 of the second part 92 for securing the first and second parts 90, 92 together. The facepiece 22 has a continuous surface 28 formed on a peripheral portion 29 of the first part 90 for receiving the filter 12.

Second part 92 of facepiece 22 comprises openings 30 through which the breath of the wearer can be inhaled. Since both facepiece 22 and filter 12 have a complementary cup shaped portion, filter 12 can be mounted on facepiece 22 and thus completely recovers openings 30 and continuous surface 28.

Second part 92 of facepiece 22 comprises a bottom wall 32 and side walls 34, all extending laterally and inwardly therefrom. As shown in FIG. 6, bottom wall 32 comprises openings 38 through which the breath of the wearer can be exhaled and two spaced apart L-shaped protuberances 40. Each side wall 34 comprises two spaced apart posts 42 and a L-shaped protuberance 44, each post 42 having a notch 46.

As shown in FIG. 6, respirator 10 further comprises an inhalation valve 48 that recovers openings 30 and an exhalation valve 50 that recovers openings 38. Inhalation valve 48 is designed to open in response to pressure from air inhaled by the wearer while exhalation valve 50 is designed to open in response to pressure from exhaled air and to ensure that the exhaled air does not pass back through filter 12 thereby preventing rebreathing of the exhaled air. Exhalation valve 50 is further designed to remain closed between the breaths of the wearer. Exhalation valve 50 is further useful as a diagnostic tool. In order to ensure that respirator 10 is properly sealed on the face of the wearer, the wearer must simply cover exhalation valve 50 and exhale. This will allow the wearer to check for leaks around the facial area or anywhere in respirator 10. It is understood that the exhalation valve can be mounted on the filter.

Cover 24 is made of a rigid or semi-rigid lightweight material such as plastic and is adapted to be hingedly secured to facepiece 22. Cover 24 has a cup shape that is complementary to cup shaped portion 26. Cover 24 is detachably mated with facepiece 22 to define with facepiece 22 a void area therebetween that is also cup-shaped and suitable to receive filter 12. Cover 24 is movable from a first position, in which the void area is opened allowing the installation or removal of filter 12, to a second position, in which cover 24 mates with facepiece 22 and filter 12 is received in the void area.

Cover 24 comprises a peripheral portion 52 and a ring 54, peripheral portion 52 and ring 54 being connected together by four branches 56. Peripheral portion 52 has a continuous surface 53 that surrounds the mouth and nose of the wearer. Ring 54 comprises an annular band 58 that extends inwardly therefrom. Cover 24 further comprises two C-shaped latches 60 extending from peripheral portion 52, each C-shaped latch 60 comprises a protuberance 62 and a finger responsive portion 64. Cover 24 also comprises a securing member 66 having a generally rectangular section 68 secured to peripheral portion 52 by a connector 70 having a groove 72. Section 68 comprises two internal notches 74.

Although cover 24 has been described herein as having branches 56 and a ring 54, it should be expressly understood that cover 24 could be of many configurations, so long as air is able to pass through cover 24 and reach facepiece 22 through filter 12. In an alternate embodiment, the cover could be made of a meshed metal. It is also understood that securing member 66 can be replaced by other securing means for securing cover 24 to facepiece 22. For example, a hinge-like connector, a strap, a hook and eye, or a press-stud can be used for securing facepiece 22 and cover 24 together.

Respirator 10 further comprises two V-shaped members 76, each V-shaped member 76 comprising first and second branches 78 and 80, each of branches 78 and 80 having a longitudinal aperture 82. Each V-shaped member 76 also comprises two spaced apart apertures 84 and an aperture 86 for receiving therein spaced apart posts 42 and L-shaped protuberance 44 respectively. Moreover, each V-shaped member 76 comprises a rectangular aperture 88 for receiving therein protuberance 62.

First part 90 comprises an aperture 94 through which L-shaped protuberances 40 of bottom wall 32 of facepiece 22 can pass. At each side, first part 90 also comprises openings 96 and an opening 98 through which posts 42 and L-shaped protuberance 44 can respectively pass.

When respirator 10 is assembled, first part 90 is notably sandwiched between bottom wall 32 and securing member 66 and between side walls 34 and V-shaped members 76. Each V-shaped member 76 is attached to body 22 when spaced-apart posts 42 and L-shaped protuberance 44 are clipped within apertures 84 and aperture 86 respectively. Cover 24 is hingedly attached to body 22 when each L-shaped protuberance 40 is clipped within internal notch 74.

As shown in FIG. 1, respirator 10 further comprises a strap 100 for holding respirator 10 over the head of the wearer. Each longitudinal aperture 82 of V-shaped member 76 allows insertion of a portion of strap 100.

It is understood that V-shaped members 76 can be secured to first part 90 instead of being secured to second part 92. It is also understood that cover 24 can be hingedly attached to first part 90 instead of being hingedly attached to second part 92. Yet, it is understood that first part 90 can comprise an aperture for receiving therein protuberance 62 of C-shaped latch 60 of cover 24. It is understood that it is not necessary for cover 24 to be hingedly attached to facepiece 22 as strap 100 can be attached to cover 24 by way of apertures similar to 82 on branches 78 and 82. Lastly, it is understood that strap 100 or other means of securing the respirator can be affixed by a variety of means, for example eyelets, rivets or adhesives.

Figure 4:
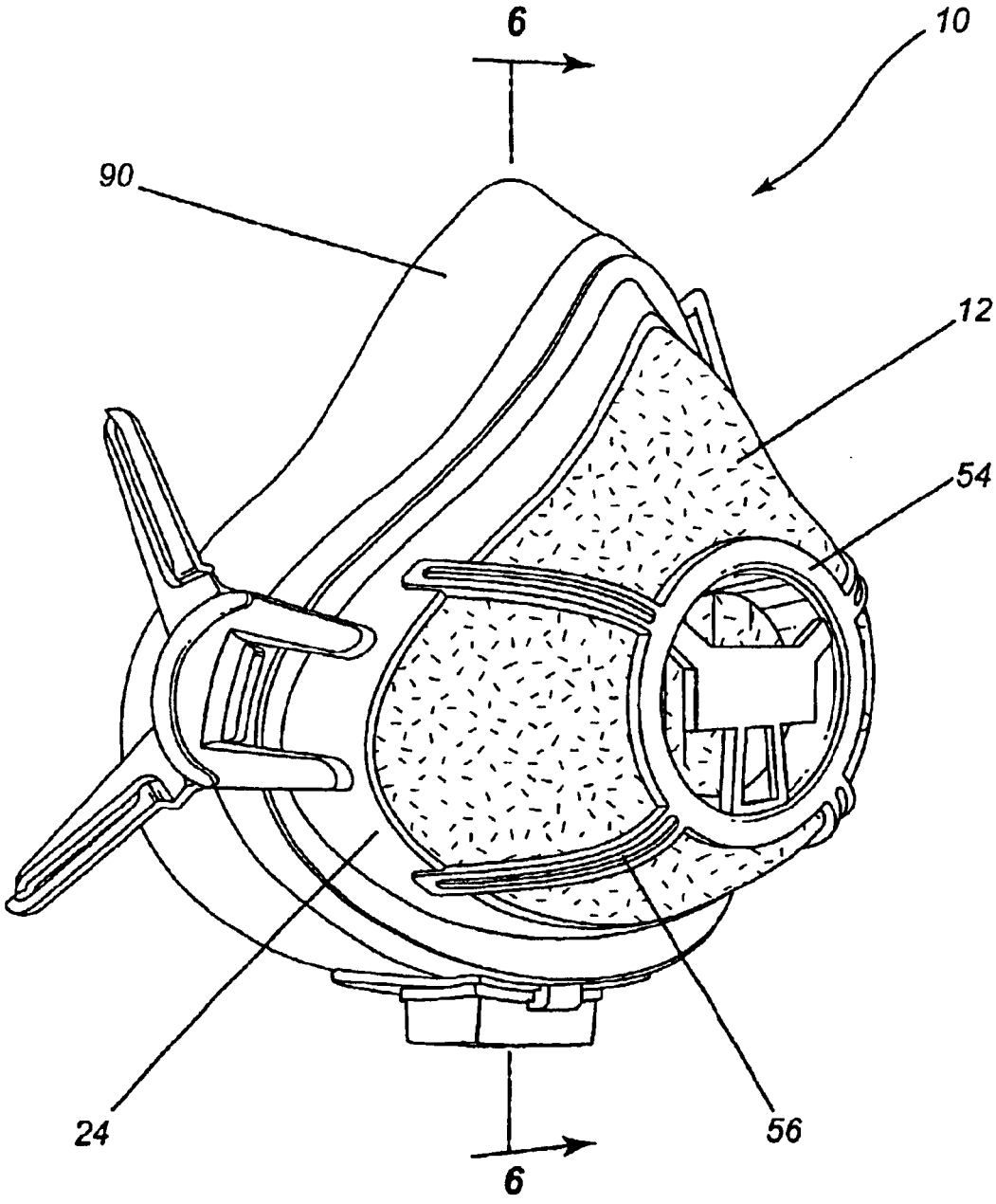
FIG. 4 is a perspective view of the respirator of FIG. 1 with the cover shown in a second position.
Figure 5:
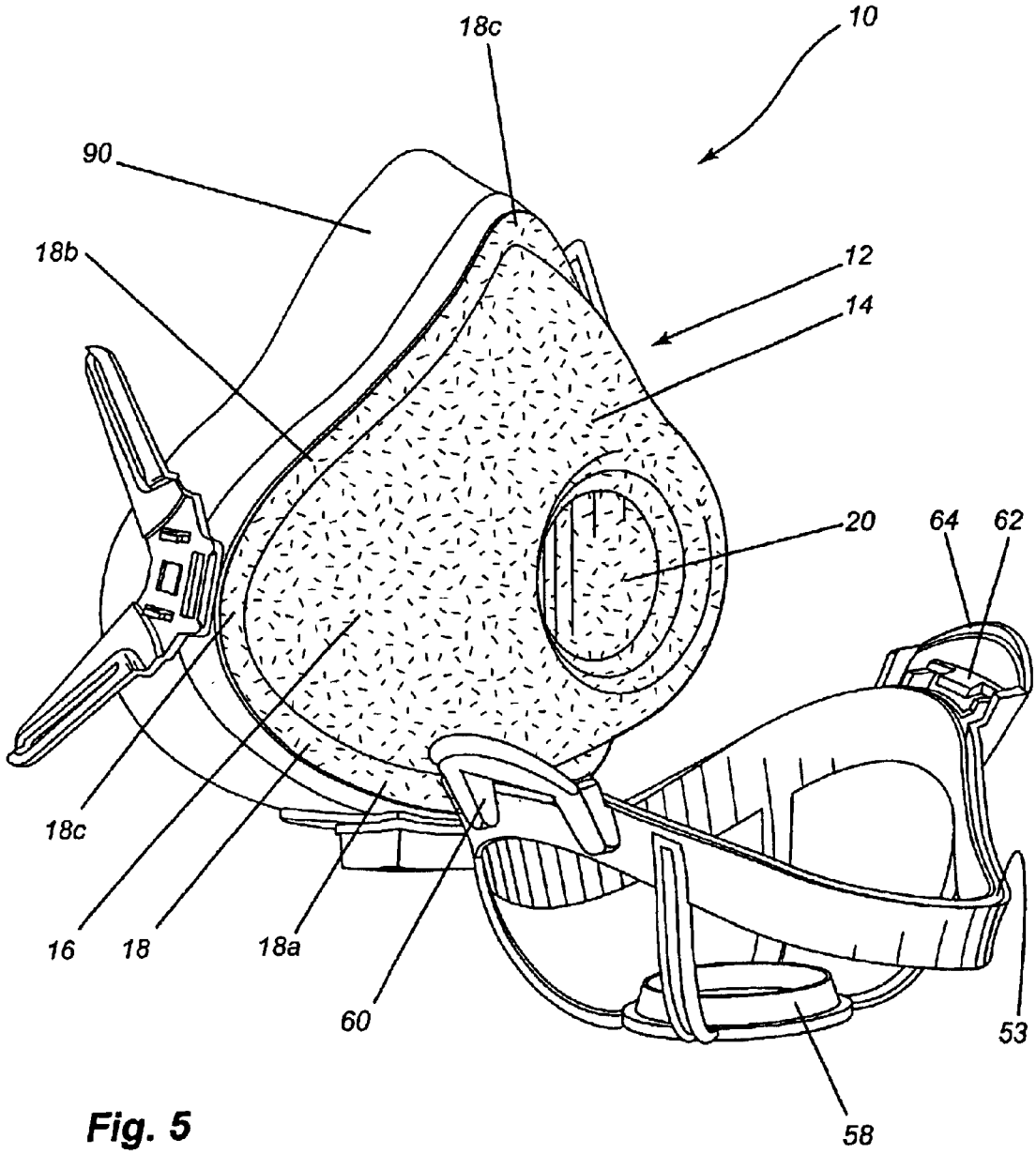
FIG. 5 is a perspective of the respirator of FIG. 1 wherein the cover is shown in the first position.

FIGS. 3 and 5 show cover 24 in a first position in which the wearer can install or remove filter 12. FIG. 4 shows cover 24 in a second position wherein cover 24 mates with facepiece 22 and the filter is received in the void area defined between cover 24 and facepiece. In the second position, continuous surface 28 of facepiece 22 is complementary with continuous surface 53 of cover 24 for sealingly engaging therebetween flange portion 18 of filter 12. In fact, flange portion 18 of filter 12 is compressed against continuous surface 28 of facepiece 22 by cover 24 thereby forming an airtight seal between facepiece 22 and filter 12.

In use, cover 24 is moved to the first position and filter 12 is then mounted on facepiece 22 so that filter 12 entirely covers openings 30. Once filter 12 has been installed, cover 24 is moved into the second position so that protuberance 62 of C-shaped latches 60 engages into aperture 88 of V-shaped members 76. In order to do so, the wearer can use finger responsive portions 64. It is understood that cover 24 is hingedly attached to facepiece 22 and groove 72 of connector 70 allows moving cover 24 between first and second positions.

Once the wearer has finished using respirator 10, or once filter 12 is saturated, the wearer can simply pull finger responsive portions 64 until protuberances 62 release from apertures 88 of V-shaped members 76, thereby causing cover 24 to disengage from facepiece 22 and move to the second position. At this point the wearer may then remove filter 12 which can be thrown away and replaced with a new disposable filter, thereby allowing respirator 10 to be reused.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A disposable filter having a cup shape and dimensions such as to cover a wearer's mouth and nose, said disposable filter being adapted to be received in a void area defined between a facepiece and a cover of a respirator, said facepiece having a cup shaped portion for sealingly engaging a face of the wearer and covering the mouth and nose of the wearer, said cover having a cup shape that is complementary to the cup shaped portion of said face piece, said cover being capable to detachably mate with said facepiece, wherein said filter comprises an apex portion, a side portion depending from said apex portion and a continuous flange portion surrounding said side portion, said flange portion projecting laterally from said side portion.

2. A disposable filter as defined in claim 1, wherein said apex portion comprises a generally circular recess.

3. A disposable filter as defined in claim 1, wherein said flange portion includes a section that overlies a chin of the face of the wearer, said section being concave.

4. A disposable filter as defined in claim 3, wherein said section is a first section, said flange includes second and third sections, said second and third sections being concave to a lesser degree than said first section.

5. A disposable filter as defined in claim 4, wherein said first section merges with said second and third sections through rounded corners.

6. A disposable filter as defined in claim 1, wherein said flange portion defines a generally triangular figure.

7. A respirator for a wearer having a face, a mouth and a nose, said respirator comprising:

(a) a facepiece comprising first and second parts, said first part being more pliable than said second part, said second part comprising an apex portion, a side portion depending from said apex portion and a continuous surface extending laterally therefrom and encircling the mouth and nose of the wearer, said first part comprising a peripheral portion covering said continuous surface of said second part and extending inwardly for defining a continuous seal sealingly engaging the face of a wearer and encircling the nose and mouth of the wearer; and (b) a cover comprising a continuous flange portion that is complementary to said peripheral portion of said first part, said cover being capable to detachably mate with said facepiece to define with said facepiece a void area; said void area being cup-shaped for receiving a filter having a complementary shape.

8. A respirator as defined in claim 7, wherein said peripheral portion of said first part comprises a first continuous surface and said continuous flange of said cover comprises a second continuous surface, said first and second continuous surfaces being complementary and operable to sealingly engage the filter therebetween when said facepiece is mated with said cover.

9. A respirator as defined in claim 8, wherein said facepiece comprises an inhalation valve mounted to said second part.

10. A respirator as defined in claim 9, wherein said facepiece comprises an exhalation valve mounted to said second part.

11. A respirator as defined in claim 7, wherein said first part is made of an elastomeric material.

12. A respirator as defined in claim 7, wherein said cover is movable from a first position, in which said void area is opened allowing the installation or removal of the filter, to a second position, in which said cover mates with said facepiece and the filter is received in said void area.

13. A respirator as defined in claim 12, wherein said cover is hingedly attached to said facepiece second part.

14. A respirator as defined in claim 13, wherein said cover comprises at least one releasable latch for locking said cover in said second position.

15. A respirator as defined in claim 14, wherein said facepiece comprises a strap over the head of the wearer for holding said respirator.

16. A respirator as defined in claim 15, wherein said facepiece comprises a V-shaped member having first and second branches, each said first and second branches comprising an aperture through which a portion of said strap passes.

17. A respirator as defined in claim 16, wherein said cover comprises a peripheral portion and a ring connected together by at least one branch, said peripheral portion comprising said second continuous surface, said ring comprising an annular band that extends inwardly therefrom.

18. A respirator as defined in claim 17, wherein said annular band engages the periphery of a central recess formed on a filter.

19. A respirator for a wearer having a face, a nose and a mouth, said respirator comprising:

(a) a facepiece comprising first and second parts and a continuous surface, said first part being more pliable than said second part, said second part comprising an apex portion, a side portion depending from said apex portion and a continuous surface extending laterally therefrom and encircling the nose and mouth of the wearer, said first part extending inwardly from said second part for defining a continuous seal sealingly engaging the face of a wearer and encircling the nose and mouth of the wearer;

(b) a cover comprising a continuous flange portion that is complementary to said continuous surface of said facepiece, said cover being capable to detachably mate with said facepiece to define with said facepiece a void area; and (c) a filter comprising an apex portion, a side portion depending from said apex portion, and a continuous flange portion surrounding said side portion, said flange portion projecting laterally from said side portion, said filter being received in said void area.

20. A respirator as defined in claim 19, wherein said first part comprises a peripheral portion covering said continuous surface of said second part, wherein said continuous surface of said facepiece is a first continuous surface formed on said first part and wherein said continuous flange portion of said cover comprises a second continuous surface, said first and second continuous surfaces being complementary and operable to sealingly engage said filter therebetween when said facepiece is mated with said cover.

21. A respirator as defined in claim 20, wherein said facepiece comprises an inhalation valve mounted to said second part.

22. A respirator as defined in claim 21, wherein said facepiece comprises an exhalation valve mounted to said second part.

23. A respirator as defined in claim 19, wherein said first part is made of an elastomeric material.

24. A respirator as defined in claim 19, wherein said cover is movable from a first position, in which said void area is opened allowing the installation or removal of said filter, to a second position, in which said cover mates with said facepiece and said filter is received in said void area.

25. A respirator as defined claim 24, wherein said cover is hingedly attached to said facepiece.

26. A respirator as defined in claim 25, wherein said cover comprises at least one releasable latch for locking said cover in said second position.

27. A respirator as defined in claim 26, wherein said facepiece further comprises a strap over the head of the wearer for holding said facepiece.

28. A respirator as defined in claim 27, wherein said facepiece comprises a V-shaped member having first and second branches, each said first and second branches comprising an aperture through which a portion of said strap passes.

29. A respirator as defined in claim 28, wherein said cover comprises a peripheral portion and a ring connected together by at least one branch, said peripheral portion comprising said second continuous surface, said ring comprising an annular band that extends inwardly therefrom.

30. A respirator as defined in claim 29, wherein said annular band engages the periphery of a central recess formed on said filter.

* * * * *